United States Patent [19]

Rehbein

[11] 4,028,858

[45] June 14, 1977

[54] DECK BLOCK

[76] Inventor: Erwin G. Rehbein, P.O. Box 80A, Waupaca, Wis. 54981

[22] Filed: Mar. 5, 1976

[21] Appl. No.: 664,156

[52] U.S. Cl. ..... 52/384; 52/578; 52/584; 52/585

[51] Int. Cl.[2] ..... E04F 13/08; E04C 1/10

[58] Field of Search ..... 52/384, 385, 578, 583, 52/579, 584–589

[56] References Cited

UNITED STATES PATENTS

| | | | |
|---|---|---|---|
| 1,575,821 | 3/1926 | Daniels | 52/578 |
| 1,906,411 | 5/1933 | Potvin | 52/578 |
| 2,310,734 | 2/1943 | Feldman | 52/585 |
| 3,266,209 | 8/1966 | Zibell | 52/584 |
| 3,513,786 | 5/1970 | Kellogg | 52/585 |

FOREIGN PATENTS OR APPLICATIONS

| | | | |
|---|---|---|---|
| 1,157,726 | 12/1957 | France | 52/585 |
| 1,522,451 | 1968 | France | 52/384 |
| 1,202,467 | 10/1965 | Germany | 52/585 |

*Primary Examiner*—J. Karl Bell

*Attorney, Agent, or Firm*—Andrus, Sceales, Starke & Sawall

[57] ABSTRACT

Strips of lumber of equal length are disposed laterally side by side to provide a substantially square block and are secured together at their corresponding ends by a metal channel strip employed as a staple with at least one flange of the metal strip driven into and embedded in the said ends and extending substantially across the end of the block. A central pin is provided in at least one side of the block for insertion into a mating recess in the adjacent side of the next block when assembling the blocks to provide a deck or floor surface.

4 Claims, 5 Drawing Figures

Fig. 1
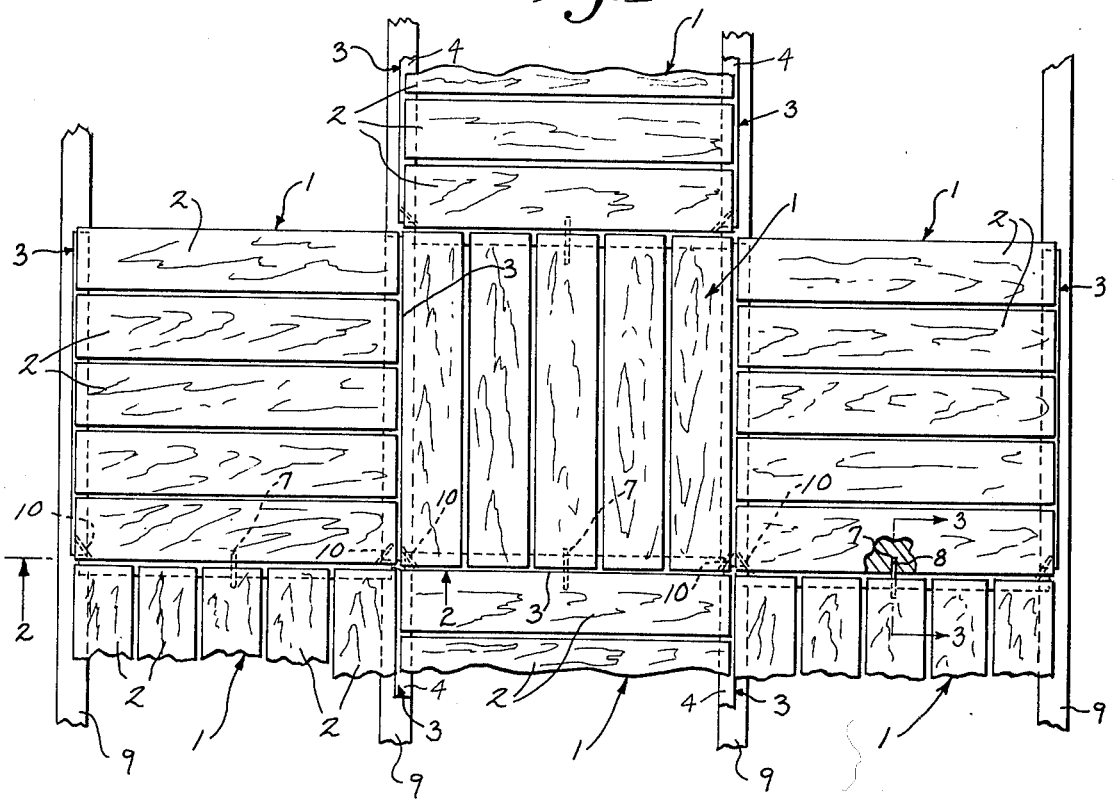
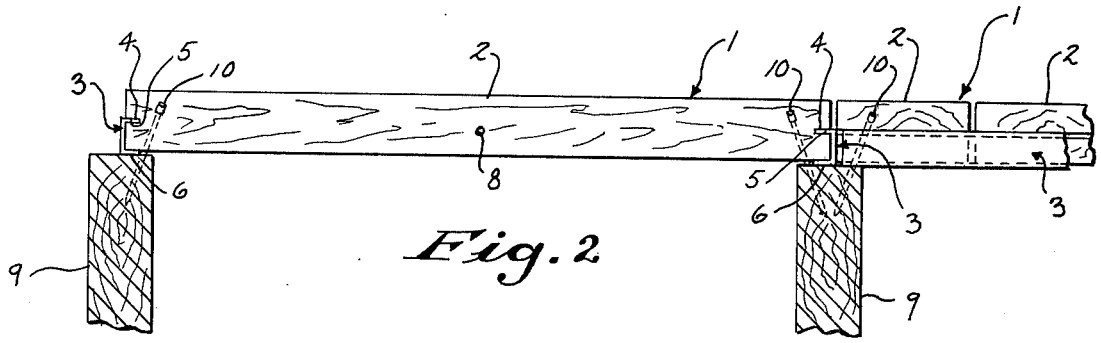
Fig. 2
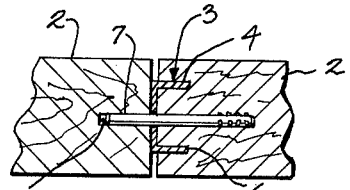
Fig. 5
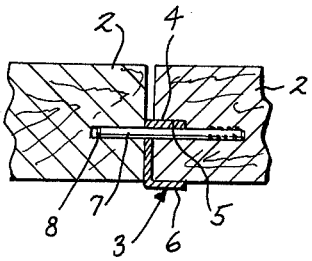
Fig. 3
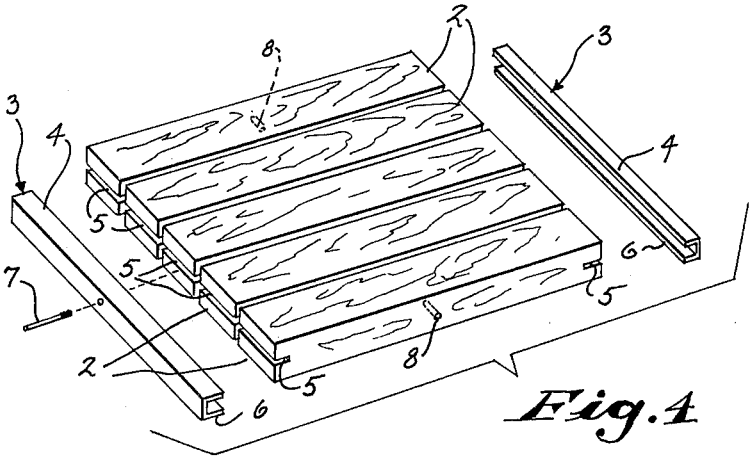
Fig. 4

DECK BLOCK

BACKGROUND OF THE INVENTION

This invention relates to deck blocks to be employed generally in the construction of decks, sidewalks, patio flooring, piers and the like where open flooring of the slat type is permissible.

Various types of panels have been employed usually made up of individual slats or boards individually secured to supporting stringers. Some have employed waste 2 × 4s cut to equal lengths and laid crosswise on and nailed to longitudinal stringers.

Prefabricated panels have been similarly constructed with various detail proposals for securing the parts. These encounter difficulties in cost and in strength for the service intended.

SUMMARY OF THE INVENTION

The present invention provides rectangular blocks made up of waste 2 × 4s cut to equal length assembled flatwise in laterally spaced arrangement and secured by a metal channel member extending across each end of the assembly with one or both flanges of the channel member driven into the ends of 2 × 4s like a continuous staple to hold the latter.

Where the completed blocks are square it is possible to assemble them upon stringers or other supports in a pattern resembling that of a parquet flooring with adjacent blocks alternating in the direction of the constituent 2 × 4s.

A pin may be provided at a predetermined location in one or more sides of each block to enter correspondingly located recesses in adjacent blocks to interlock the blocks when assembled.

BRIEF DESCRIPTION OF THE DRAWINGS

The accompanying drawings illustrate the best mode presently contemplated for carrying out the invention.

In the drawing:

FIG. 1 is a plan view of a deck made up of deck blocks with a part broken away and sectioned;

FIG. 2 is a transverse vertical section taken on line 2—2 of FIG. 1;

FIG. 3 is a detail vertical section taken on line 3—3 of FIG. 1;

FIG. 4 is an exploded perspective view showing the parts prior to assembly; and

FIG. 5 is a detail section similar to FIG. 3 illustrating the construction of another embodiment.

DESCRIPTION OF THE PREFERRED EMBODIMENT

Referring to the drawings, FIGS. 1–4 illustrate a substantially square deck block 1 comprising a plurality, preferably five 2 × 4 pieces of wood 2 cut to equal lengths and arranged flatwise in laterally spaced relation.

A metal channel member 3 having a base width to approximately one-half the thickness of the wood pieces 2 has its upper flange 4 driven or otherwise embedded in a corresponding groove 5 extending across the ends of the wood pieces, and its lower flange 6 preferably extending beneath the ends of the pieces 2 in support thereof.

The channel member 3 is of a length to extend substantially across the end of the block 1 and to secure all of the 2 × 4s 2 in place.

The flanges 4 and 6 are of a depth generally equal to the base width of the channel and sufficient to provide a strong interlock with the wood pieces 2.

A pin 7 is shown as extending outwardly through a hole in the base of channel 3 near the center thereof, and a mating recess 8 is provided in the exposed edge of the side pieces 2 at a corresponding location to receive the pin 7 when two blocks 1 are arranged side by side with their wood pieces 2 oriented at right angles to each other.

In constructing a deck or other flooring, a plurality of blocks 1 are arranged on suitable stringers 9 with the 2 × 4s 2 of adjacent blocks extending at right angles to each other to form a parquet pattern as shown in FIG. 1.

The blocks 1 are then nailed to the stringers 9 by suitable toenails 10 at the corners of the blocks.

A modification of the construction is illustrated in FIG. 5 where both flanges 4 and 6 of the channel member 3 are driven into the ends of the wood pieces 2. In this construction the channel member 3 may preferably be of less base width than in the embodiment of FIGS. 1 to 4.

The deck blocks 1 of the present invention are very rigid and do not tend to warp, a feature which facilitates assembly in use.

Additionally, the channel member 3 securely holds each wood piece 2 against warping and thereby maintains an even flooring for the deck or the like.

Various modes of carrying out the invention are contemplated as being within the scope of the following claims particularly pointing out and distinctly claiming the subject matter which is regarded as the invention.

I claim:

1. A deck block comprising a plurality of strips of wood of equal length disposed side by side in loosely spaced relation with their ends in a common plane, and channel members extending one each across the corresponding aligned ends of said strips each of said channel members including a body and internal side flanges with one inturned side flange of said member frictionally embedded in a groove substantially parallel to the common plane of the strips and extending inwardly from the ends in all of said strip ends and with the body of each said member bearing substantially tightly against the corresponding aligned ends of said strips, and with the other inturned side flange of each of said members frictionally engaging said strips, whereby each said channel member totally engages and retains said strips in spaced position.

2. The deck block of claim 1 in which the other flange of said channular member is disposed beneath said strip ends in direct frictional contact therewith to additionally support said strips.

3. The deck block of claim 1 in which both flanges of said channular member are embedded in corresponding grooves of said strip ends.

4. The deck block of claim 1 and a pin protruding through the body of said metal member and adapted to enter a recess in the side of a strip of an adjacent block to align said blocks in an assembly, said pin having means on its inner end to interlock the same with said member and prevent displacement of the pin in transport.

* * * * *